US008257052B2

(12) United States Patent
Livoti

(10) Patent No.: US 8,257,052 B2
(45) Date of Patent: Sep. 4, 2012

(54) DEVICE FOR DRIVING AN ELECTROMAGNET FOR OPERATING A PUMP, AND RELATED ELECTROMAGNETIC DOSING PUMP

(75) Inventor: Stefano Livoti, Rieti (IT)

(73) Assignee: Seko S.p.A., Cittaducale (RI) (IT)

( * ) Notice: Subject to any disclaimer, the term of this patent is extended or adjusted under 35 U.S.C. 154(b) by 1211 days.

(21) Appl. No.: 11/995,470

(22) PCT Filed: Jul. 7, 2006

(86) PCT No.: PCT/IT2006/000517

§ 371 (c)(1),
(2), (4) Date: Jan. 11, 2008

(87) PCT Pub. No.: WO2007/007365

PCT Pub. Date: Jan. 18, 2007

(65) Prior Publication Data

US 2008/0226464 A1 Sep. 18, 2008

(30) Foreign Application Priority Data

Jul. 13, 2005 (IT) ..... RM2005A0373

(51) Int. Cl.
*F04B 49/00* (2006.01)

(52) U.S. Cl. ..... 417/23; 417/44.11; 417/53; 222/63; 222/385

(58) Field of Classification Search ..... 417/1, 12, 417/44.2, 44.11, 53; 700/282; 222/63; 318/430–434, 568.22
See application file for complete search history.

(56) References Cited

U.S. PATENT DOCUMENTS

| | | | | |
|---|---|---|---|---|
| 3,610,781 | A | 10/1971 | Kolb et al. | |
| 6,107,774 | A * | 8/2000 | Yamada et al. | 318/807 |
| 6,192,299 | B1 * | 2/2001 | Kubota et al. | 700/282 |
| 6,264,432 | B1 * | 7/2001 | Kilayko et al. | 417/44.1 |
| 6,283,717 | B1 | 9/2001 | Yamada | |
| 6,595,756 | B2 * | 7/2003 | Gray et al. | 417/44.1 |
| 2005/0059926 | A1 * | 3/2005 | Sage et al. | 604/65 |
| 2008/0001560 | A1 | 1/2008 | Livoti | |
| 2008/0140258 | A1 * | 6/2008 | Ueno et al. | 700/260 |
| 2008/0294098 | A1 * | 11/2008 | Sarkinen et al. | 604/67 |
| 2011/0085923 | A1 * | 4/2011 | Gray et al. | 417/279 |

FOREIGN PATENT DOCUMENTS

| | | |
|---|---|---|
| IT | 1315957 | 1/2002 |
| IT | RM2004RM00371 | 7/2004 |

* cited by examiner

*Primary Examiner* — Devon Kramer
*Assistant Examiner* — Ryan Gatzemeyer
(74) *Attorney, Agent, or Firm* — Roberts Mlotkowski Safran & Cole P.C.

(57) ABSTRACT

A device and method are disclosed for driving an electromagnet for operating a pump. The electromagnet includes a primary winding and a moving element that is attracted within the primary winding when an energizing current is higher than a first threshold value. The moving element lets a liquid dose into an external hydraulic circuit depending on the a travel of the moving element. A control logic unit detects an energizing current to provide the energizing current to the primary winding until the energizing current assumes a second threshold value, depending on a value of the liquid dose to let into the external hydraulic circuit. The second threshold value is higher than the first threshold value and not higher than a third threshold value in correspondence of which the moving element arrives at a stop.

34 Claims, 5 Drawing Sheets

DEVICE FOR DRIVING AN ELECTROMAGNET FOR OPERATING A PUMP, AND RELATED ELECTROMAGNETIC DOSING PUMP

CROSS-REFERENCE TO RELATED APPLICATIONS

The present Application is a U.S. national phase of PCT/IT/2006/000517 filed on Jul. 7, 2006 ("PCT Application"), which claims priority from Italian Application No. RM2005A000373 filed on Jul. 13, 2005, both of which are hereby incorporated by reference in their entirety into the present Application. The PCT Application includes Notification of Transmittal of the International Preliminary Report on Patentability and the Amended Sheets attached thereto.

FIELD OF THE INVENTION

The present invention relates to a device for driving an electromagnet for operating a pump, such as for instance pumps for dosing liquids, that allows, in a simple, reliable, efficient, precise, and inexpensive way, to adjust the capacity of the cap integral with the moving element of the electromagnet without the aid of position sensors or calibration electro-mechanical devices, thus allowing a precise control of the capacity as pressure outside the pump, exerted by the external hydraulic circuit, varies.

The present invention further relates to the corresponding dosing electromagnetic pump, provided with such driving device, and to the method for driving the electromagnet.

BACKGROUND OF THE INVENTION

It is known that electromagnetic pumps are employed for adding liquids, such as detergents, sanitisers, and disinfectants, to aqueous solutions through a predeterminable dosage repeatable in time.

In particular, the liquid is dosed into the solution through the mechanical action of an interposition membrane, moved by the action of two opposed forces: a pushing force, obtained through the magnetic attraction exerted on a ferromagnetic piston by an electromagnet, suitably driven by an electronic control circuit, and a return force, obtained through the repulsive action of a spring coaxial with the piston that is loaded by the same piston during the pushing phase. During the operation, the electromagnet is operated by an electric current and it pushes the piston into the pump body, so that, through suitable valves, the liquid to dose is let into the hydraulic circuit; the piston is then brought back to rest by the spring loaded during the active pushing phase.

At each injection or stroke a certain quantity of liquid is let into the hydraulic circuit, whereby multiplying it by the number of injections (strokes) per minute the capacity in the time unit is obtained, usually measured in liters/hour.

Presently, for reasons of adaptability to the hydraulic equipments where they are installed, dosing electromagnetic pumps need adjustments defining the capacity thereof as a function of the operating pressure and of the dosed liquid viscosity.

Therefore all the manufacturing companies give as adjustments the number of stroke/minute (conventionally indicated in liters/hour) necessary for obtaining a certain capacity: by adjusting the number of strokes/minute the quantity of liquid let into the hydraulic circuit in the time unit may be varied.

However, such solution suffers from the drawback that the reduction of the number of strokes, which all arrive to the piston stop, produces as a consequence that dosage concentrations are significantly non uniform in the time unit.

Some alternative solutions comprise a device that is provided with a further adjustment of the piston stroke through mechanical means, by limiting the movement of the cap, operated by the piston, that in turn moves the membranes. In particular, such solutions provide that the origin of the stroke is moved towards the stop limit (i.e., it is moved forward), whereby the volume of the injected liquid is directly proportional to the residual movement of the piston.

However, even these solutions have great functionality limitations, due to the fact that the pump capability of priming the liquid to dose contained in a suitable tank is greatly limited.

Further solutions use sensors for detecting the movement of the piston, and hence of the moving cap.

However, such solutions suffer from the drawback the adjusting device is extremely complex and expensive, since it needs very sophisticated and extremely precise sensors, considering that travels at stake are typically of the order of one or two millimeters, and they are hardly installable within the pump, due to the reduced room within the same.

Moreover, it is however left the main problem of the large variation which capacity undergoes as the operating pressure applied outside the pump by the hydraulic circuit into which the liquid to dose is to be let varies. In fact, for functional reasons of hydraulic nature, the membrane pushing the liquid must have elastic characteristics which are then the cause of the capacity variations as pressure varies. Such elastic coefficient is determined by the geometric shape and by the material of which the membrane is made, typically Teflon.

SUMMARY OF THE INVENTION

By way of example, FIG. 1 shows the diaphragm profile at two different values of external pressure: the membrane assumes the profile A when the external pressure is equal to 50 KPa (0.5 bar), while it assumes the profile B when the external pressure is equal to 1000 KPa (10 bar). It is evident that in the first case the quantity of liquid let into the external hydraulic circuit is significantly larger than the one in the second case. Obviously, the phenomenon still grows as pressure gets higher, when it is considered that the usual limit for electromagnetic pumps is equal to about 2000 KPa (20 bar). As a consequence, it would be also necessary a sensor of operating pressure applied outside the pump, making even more complex and expensive the adjusting device.

It is therefore an object of the present invention to provide a device for driving an electromagnet for operating pumps that allows, in a simple, reliable, efficient, precise, and inexpensive way, to adjust the capacity of the pump over a wide range, by keeping dosage uniformity, without the aid of cap integral with the moving element of the electromagnet without the aid of position or pressure sensors, or of calibration electro-mechanical devices, thus allowing a precise control of the capacity as the pressure outside the pump, exerted by the external hydraulic circuit, varies.

It is further an object of the present invention to provide such a driving device that allows to improve both the manufacture and the engineering applicability of electromagnets for operating pumps.

It is therefore specific subject matter of the present invention a device for driving an electromagnet for operating a pump, the electromagnet comprising a primary winding, capable to be passed through by an energising current, and a moving element, capable to be attracted within the primary winding when said energising current is higher than a first threshold value so as to let a liquid dose into an external hydraulic circuit depending on the travel of the moving element, the device comprising a control logic unit, capable to control said energising current, the device being characterised in that the control logic unit is capable to detect said energising current so as to provide said energising current to the primary winding until said energising current assumes a second threshold value, depending on a value of the liquid dose to let into the external hydraulic circuit, higher than the first threshold value and not higher than a third threshold value in correspondence of which the moving element arrives at stop.

Always according to the invention, the control logic unit may determine the second threshold value as the sum of a fourth threshold value, detected at an instant successive, by a constant interval not shorter than 0, to the instant at which said energising current begins to flow through the primary winding and preceding the instant at which said energising current assumes the third threshold value, with a quantity not larger than the difference between the third threshold value and the fourth threshold value, said quantity depending on a value of the liquid dose to let into the external hydraulic circuit.

Still according to the invention, the fourth threshold value may be equal to the first threshold value, whereby the control logic unit determines the second threshold value as the sum of the first threshold value, detected at an instant successive, by a constant interval, to the instant at which said energising current begins to flow through the primary winding, with a quantity not larger than the difference between the third threshold value and the first threshold value, said quantity depending on a value of the liquid dose to let into the external hydraulic circuit.

Furthermore according to the invention, the device may comprise electronic means for compensating variations of the resistance of the primary winding controlled by the control logic unit, the control logic unit being capable, when it does not provide said energising current, to provide to the primary winding a measuring current, lower than the first threshold value, and to measure a voltage drop across the primary winding for determining if the resistance of the primary winding is varied and, in the positive, for controlling said electronic compensating means for compensating such resistance variation.

Always according to the invention, the fourth threshold value may be equal to 0, whereby the control logic unit determines the second threshold value as being equal to a quantity not larger than the third threshold value, said quantity depending on a value of the liquid dose to let into the external hydraulic circuit.

Still according to the invention, the control logic unit may cyclically provide said energising current to the primary winding until said energising current assumes the third threshold value in correspondence of which the moving element arrives at stop.

Furthermore according to the invention, when it provides said energising current to the primary winding until said energising current assumes the third threshold value, the control logic unit may determine a pressure exerted by the external hydraulic circuit onto the pump as proportional to the time interval passing since a reference instant, ranging from the instant at which said energising current begins to flow through the primary winding to the instant at which said energising current assumes the third threshold value, to the instant at which said energising current assumes the third threshold value.

Always according to the invention, said reference instant may be equal to the instant at which said energising current begins to flow through the primary winding or to the instant at which said energising current assumes the first threshold value.

Still according to the invention, the control logic unit may calculate the second threshold value as a function of the determined value of external pressure.

Furthermore according to the invention, the control logic unit may be provided with memory means storing at least one, preferably updatable, look-up table which the control logic unit accesses for reading said second threshold value as a function of the determined value of external pressure.

Always according to the invention, the pump may comprise a membrane having an elastic coefficient, the control logic unit determining the second threshold value as a function of the membrane elastic coefficient.

Still according to the invention, the control logic unit may calculate the second threshold value as a function of the membrane elastic coefficient.

Furthermore according to the invention, the control logic unit may be provided with memory means storing at least one, preferably updatable, look-up table which the control logic unit accesses for reading the second threshold value as a function of the membrane elastic coefficient.

Always according to the invention, the device may further comprise first selecting means, connected to the control logic unit, capable to select said value of the liquid dose to let into the external hydraulic circuit.

Still according to the invention, the device may further comprise second selecting means, connected to the control logic unit, capable to select a viscosity of the liquid to let into the external circuit.

Furthermore according to the invention, the control logic unit may calculate the second threshold value as a function of the selected viscosity of the liquid to let into the external circuit.

Always according to the invention, the control logic unit may be provided with memory means storing at least one, preferably updatable, look-up table which the control logic unit accesses for reading the second threshold value as a function of the selected viscosity of the liquid to let into the external circuit.

It is still specific subject matter of the present invention a dosing electromagnetic pump, comprising an operating electromagnet controlled by a driving device, characterised in that the driving device is a driving device as previously described.

It is still specific subject matter of the present invention a method for driving an electromagnet for operating a pump, the electromagnet comprising a primary winding, capable to be passed through by an energising current, and a moving element, capable to be attracted within the primary winding when said energising current is higher than a first threshold value so as to let a liquid dose into an external hydraulic circuit as a function of the travel of the moving element, the method being characterised in that it comprises the following steps:

A. detecting said energising current;

B. providing said energising current to the primary winding until said energising current assumes a second threshold value, depending on a value of the liquid dose to let into the external hydraulic circuit, larger than the first threshold value and not larger than a third threshold value in correspondence of which the moving element arrives at stop.

Always according to the invention, the method may further comprise the following step:

E. cyclically providing said energising current to the primary winding until said energising current assumes the third threshold value in correspondence of which the moving element arrives at stop.

Further embodiments of the method according to the invention are defined by dependent claims 20-35.

BRIEF DESCRIPTION OF THE DRAWINGS

The present invention will now be described, by way of illustration and not by way of limitation, according to its preferred embodiments, by particularly referring to the Figures of the enclosed drawings, in which.

DETAILED DESCRIPTION

In the Figures, alike elements are indicated by same reference numbers.

The inventor has developed an adjustable capacity driving device for driving an electromagnet for operating pumps that uses a purely electronic detection of the piston stop based on the sampling of the curve of the current imparted to the electromagnet, by searching for the characteristic points of the current curve along time. Such detection will be as more precise as higher is the number of the sampled values in the time unit.

Figure 1:
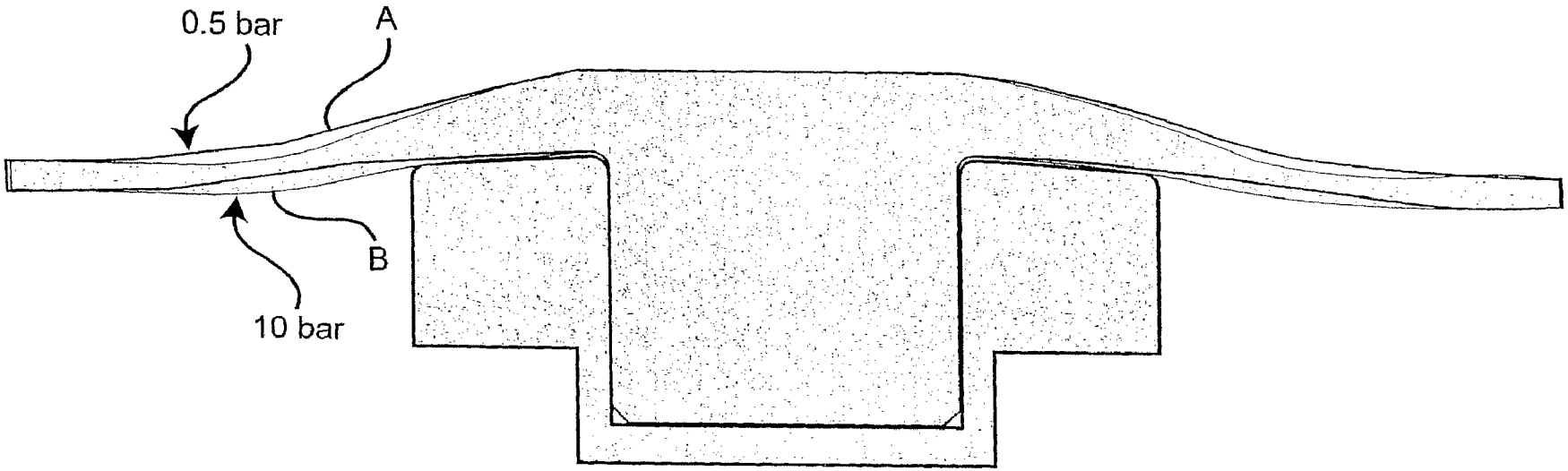
FIG. 1 schematically shows the profile of a membrane of a pump undergoing two different values of external pressure.
Figure 2:
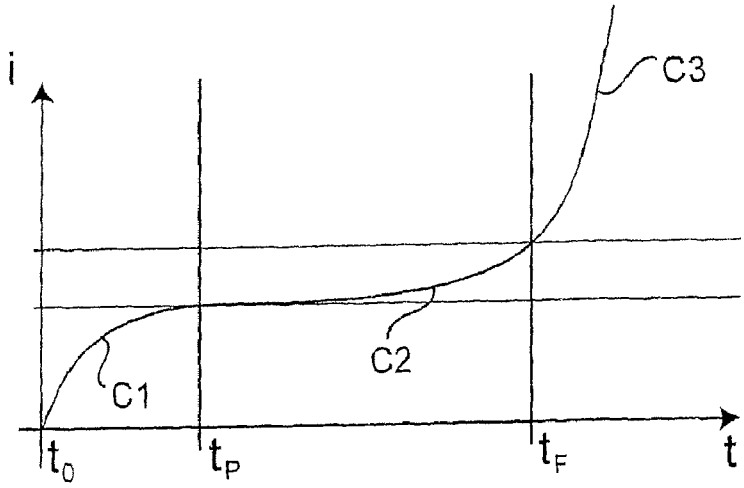
FIG. 2 shows the curve of an energising current of an electromagnet for operating a pump.

In particular, with reference to FIG. 2, it may be observed that the curve in time of the current flowing through the electromagnet, the piston of which is initially held by the coaxial spring load, substantially comprises three parts: a first part C1 from $t_0$ (instant at which the driving device begins to make the current i(t) flow through the electromagnet) up to $t_P$ (instant at which the current i(t) finally overcomes the initial resistance of the spring load), wherein the piston and the cap remain motionless; a second part C2 from $t_P$ (instant at which the piston begins to move) up to $t_F$ (instant at which the piston reaches the stop, i.e. it arrives at beat), wherein the current i(t) exponentially increases from value $i(t_P)$ by a value equal to V/R, according to the known formula of load of an inductor having inductance L through a series resistance R $$i(t) = i(t_P) + \frac{V}{R}\left(1 - e^{-\frac{R}{L}t}\right)$$

where L/R is the typical electromagnet time constant; and a third part C3 from $t_F$ (instant at which the piston reaches the stop) wherein the current i(t) increases very fast beyond the value $i(t_F)$.

Hence, by keeping the ratio V/R constant, during the second part C2 the current i(t) grows in an exponential way with a time constant that is typical of the same magnet. Since the traction force is directly proportional to the current i(t), during the second part C2 of the curve of the current, at the instant $t_F$ the latter arrives at overcoming all the counteracting operating pressure, allowing the cap to make the whole travel. Therefore, the duration of the second part C2, equal to $(t_F-t_P)$, is proportional to pressure: the longer the necessary time is, the higher the pressure is, and vice versa. At this point the system is capable to know, depending on the time that is detected as necessary to the current i(t) for exponentially increasing by V/R starting from the value $i(t_P)$, how high the operating pressure is. Moreover, as soon as the current increase necessary for making the cap arrive at beat is reached, the driving device may interrupt the current to the electromagnet and it may again set for a new cycle, causing the piston to return to its starting position by means of the traction of the loaded spring.

Figure 3:
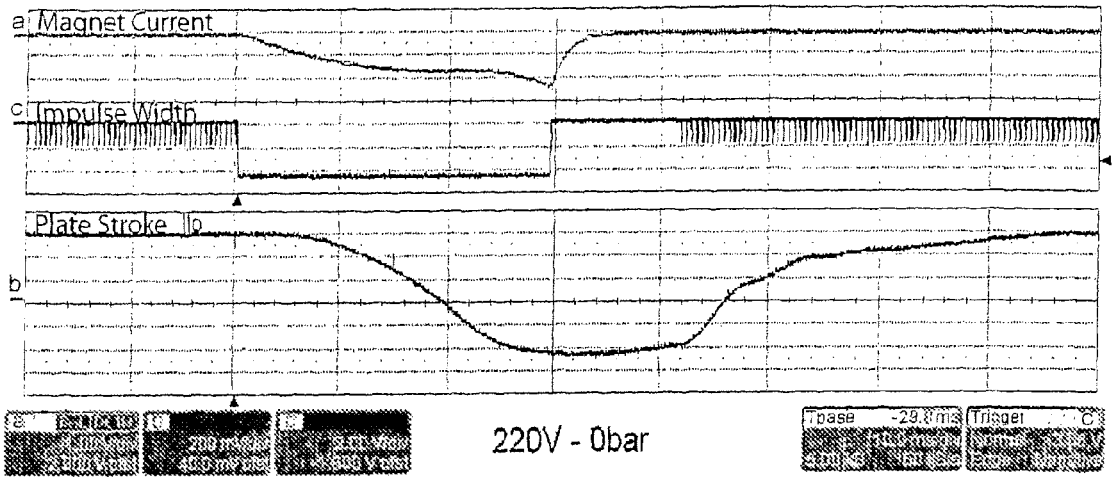
FIG. 3 shows the curve of the energising current of an electromagnet, the pulse length, and the cap travel at the operating pressure of 0 KPa (0 bar)
Figure 4:
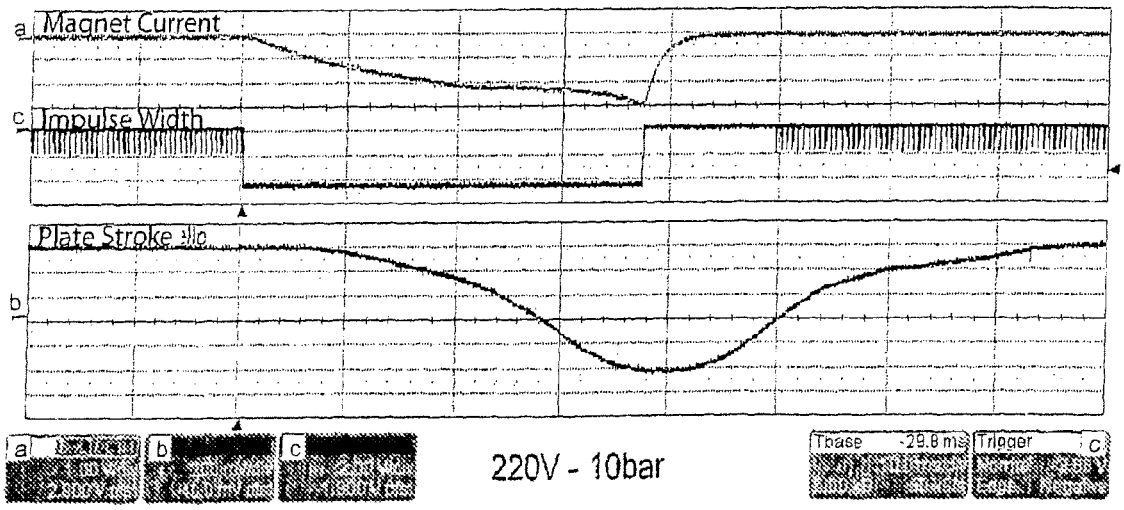
FIG. 4 shows the curve of the energising current of an electromagnet, the pulse length, and the cap travel at the operating pressure of 1000 KPa (10 bar)

FIGS. 3 and 4 make clear the curve of the current i(t), the pulse length, and the cap travel at operating pressures of 0 KPa (0 bar) and 1000 KPa (10 bar), respectively. In particular, it should be noted that in FIGS. 3 and 4 the travel is represented with a definition of two tenth of millimeter per square.

Figure 5:
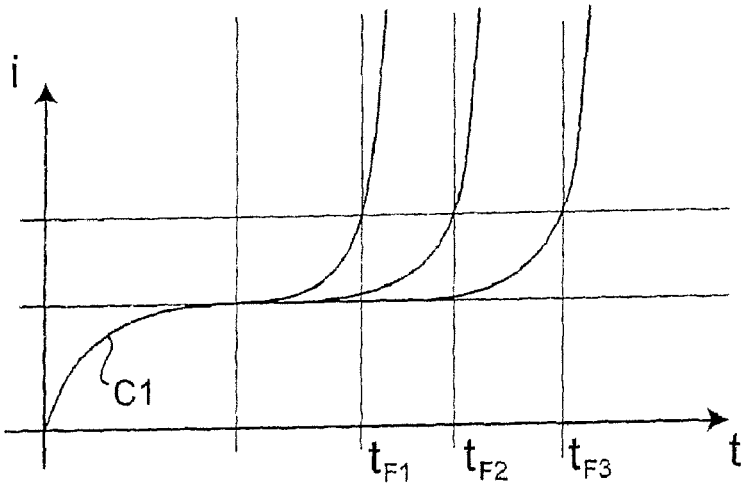
FIG. 5 shows the curves of the energising current of an electromagnet for operating a pump for three values of operating pressure, under conditions of identical circuit electrical constants.

Therefore, by assuming that electromagnet circuit electrical constants do not vary, FIG. 5 schematises the shape of the curve of current i(t) as the counteracting operating pressure varies, wherein the instant $t_F$ at which the piston reaches the stop, i.e. it arrives at beat, is delayed proportionally to the counteracting pressure P, whereby $$t_{F1}=t_F(P1)<t_{F2}=t_F(P2)<t_{F3}=t_F(P3),$$

with P1<P2<P3

The inventor has further developed the driving device on the basis of the fact that, even when the circuit electrical constants vary (e.g. because of a temperature variation), since the electromagnet is very "air-gapped", the shape of the curve of the current i(t) always comprises characteristic points subdividing the same in a recognisable way, i.e. in a detectable way, into the three aforementioned parts C1, C2, and C3.

Figure 6:
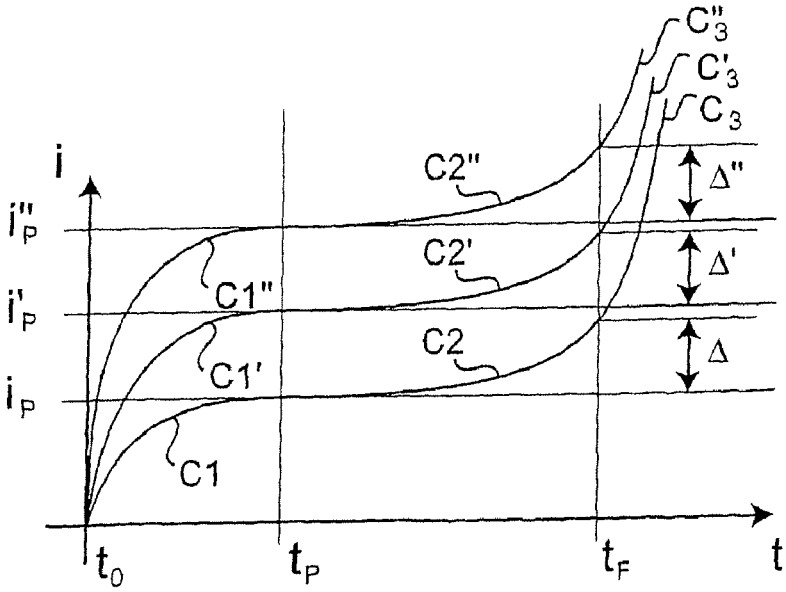
FIG. 6 shows the curves of the energising current of an electromagnet for operating a pump for three values of circuit electrical constants, under conditions of identical operating pressure.

In fact, with reference to FIG. 6, showing three curves of the current i(t) for three different values of the circuit constants of the same electromagnet, it may be observed that, by assuming a constant external operating pressure, as the circuit electrical constants vary the three curves of the current i(t) always reach at the same instant $t_F$ the value necessary to overcome the initial resistance of the spring load, whereby the length $(t_P-t_0)$ of the first part C1, C1', and C1" of the three curves is constant; such value varies as the electromagnet circuit constants vary ($I_P<I_P'<I_P''$, assuming an operating temperature increasing with the three corresponding curves).

Once the three current curves have reached their respective value necessary to overcome the initial resistance of the spring load, they all continue with a second part C2, C2', and C2" of exponential increase from $t_P$ up to $t_F$ (instant at which the piston reaches the stop, i.e. it arrives at beat), wherein the instant $t_F$ is the same instant (in the hypothesis that the operating counteracting pressure is the same for the three curves). In particular, the three second parts C2, C2', and C2" are amplitude shifted (along the y axis), whereby the value of current increase in the second part is constant for any variation of the circuit electrical constants ($\Delta=\Delta'=\Delta''$).

Finally, the three curves follow a respective third part C3, C3', and C3" starting from $t_F$, that varies depending on the circuit electrical constants. However, since the third part of the curve of current i(t) is not significant, because it only produces an useless current consumption, whereby the driving device interrupts the current to the electromagnet for again setting for a new cycle, the variation of this third part as the circuit electrical constants vary is not relevant.

In the following, explicit reference will be made to an architecture of the driving device similar to that of the device described in the Italian Patent Application No. RM2004AC00371, herein incorporated by reference. However, it should be understood that the invention may be also applied to driving devices adopting other circuit architectures, still remaining within the scope of the present invention.

Figure 7:
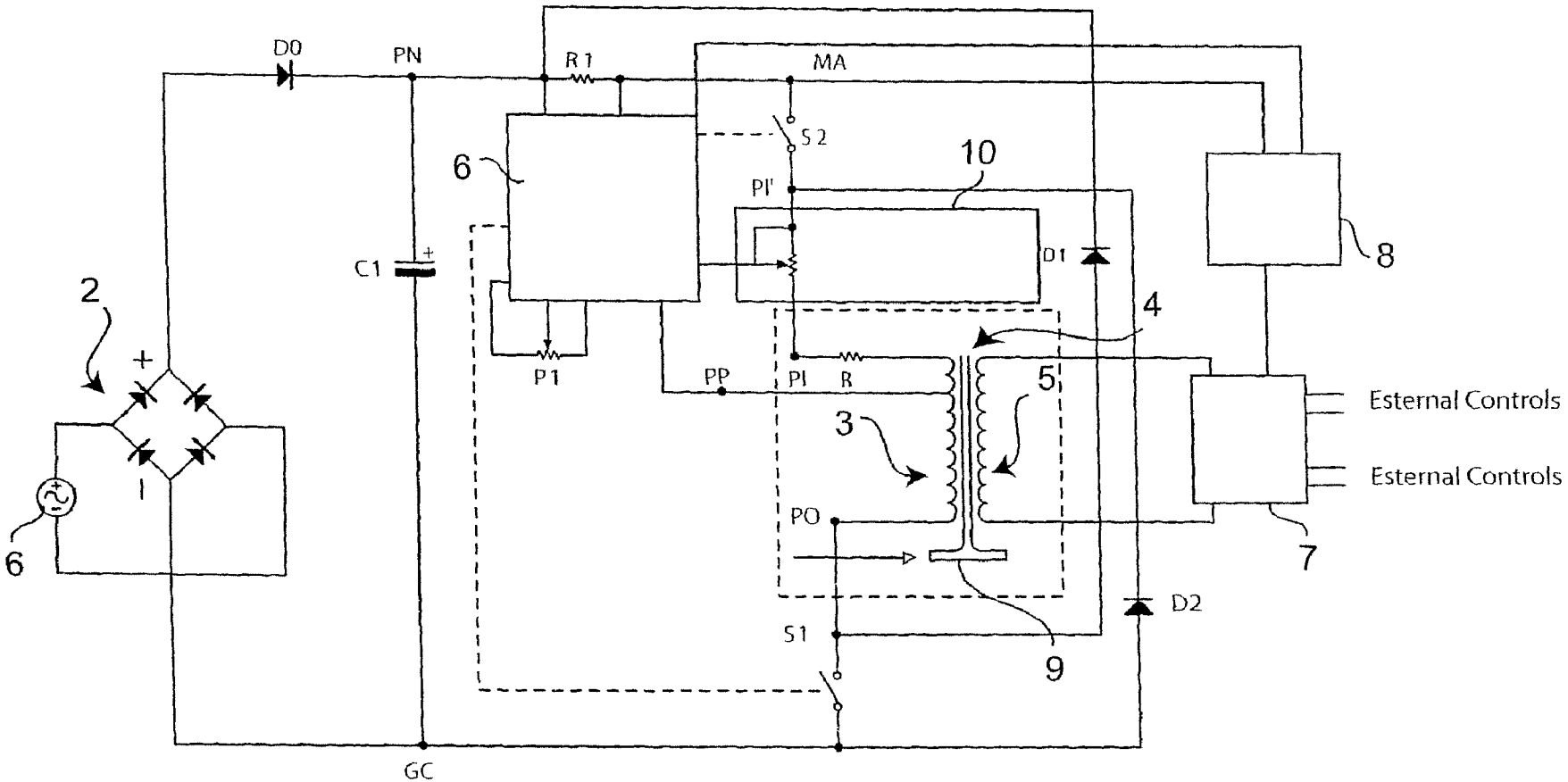
FIG. 7 shows a preferred embodiment of the driving device according to the invention.

FIG. 7 shows a schematic circuit diagram of the preferred embodiment of the driving device according to the invention, wherein, in particular, the power electronic switches are represented by simple on-off switches.

The device according to the invention is connected to the mains 1 through a rectifier bridge 2 and a blocking diode D0 (preventing reverse currents from occurring), the output voltage of which is stabilised by the capacitor C1 and provided, after a resistor R1, on a power supply terminal MA.

A first power switch S1 is connected between the output terminal PO of a primary winding 3 of the electromagnet 4 and the circuit ground GC. A second power switch S2 is connected between the power supply terminal MA and a terminal PI', connected to the input terminal PI of the primary winding 3 of the electromagnet 4 through a resistance compensating electronic control stage 10, the functionality of which will be illustrated below.

A second diode D1 is connected between the terminal PO and the positive node PN of the stabilising capacitor C1, before the resistor R1, with polarity such that it allows current to flow from the terminal PO to the positive node PN. A third diode D2 is connected between the circuit ground GC and the terminal PI', with polarity such that it allows current to flow from the circuit ground GC to the terminal PI'. In particular, the second and the third diodes D2 and D3 perform the same functions of the similar diodes of the control device that is subject matter of the Italian Patent No. IT1315957, herein incorporated by reference.

A first control logic unit 6, not galvanically insulated, controls the operation of power switches S1 and S2, it controls the value of the compensating resistance of stage 10, and detects the power supply current flowing through the primary winding 3 of the electromagnet 4, through measuring the voltage on the resistor R1. Moreover, the first control logic unit 6 is connected to a regulation potentiometer P1, adjustable by an operator for indicating the desired capacity of the electromagnetic pump. The power supply necessary to the operation of the first control logic unit 6 is provided by a suitable shunt PP of the primary winding 3 of the electromagnet 4.

The device further comprises a second control logic unit 7, capable to communicate (in reception and/or in transmission) through digital and/or analog signals with external devices. In particular, the second control logic unit 7 is capable to further communicate with the first control logic unit 6 through a galvanic insulation unit 8. The power supply necessary to the operation of the second control logic unit 7 is provided by a suitable secondary winding 5 of the electromagnet 4.

As said before, the electromagnet 4 is provided with a moving element 9 capable to be attracted within the same electromagnet by the current flowing through the primary winding 3.

On the basis of what previously set forth, it is evident that once the time ($t_F-t_P$) necessary to the piston for making the whole travel is known, by assuming that the operating counteracting pressure remains constant, the first control logic unit 6 may adjust the electromagnetic pump capacity, limiting the travel of the piston 9, by simply giving current to the electromagnet only for a portion of the second part C2 of the current curve shown in FIG. 2. In this way, the device according to the invention replaces the mechanical regulation of presently available adjustable capacity electromagnetic pumps with a wholly electronic, extremely reliable, precise, and inexpensive system.

Moreover, the first control logic unit 6 is capable to adapt the driving and capacity regulation in the case where the operating counteracting pressure varies. In fact, by reducing the time of electromagnet current supply as described (for reducing the piston travel in a completely electronic way), the current curve is prevented from reaching the instant $t_F$ of stop of the piston 9, not obtaining the check of the instant operating counteracting pressure that, e.g. due to equipment reasons, could vary. In order to overcome this problem, the first control logic unit 6, after a (either predefined or adjustable) number of strokes of the piston 9 with reduced travel (on the basis of the indication of the potentiometer P1), cyclically carries out a "calibration" driving with which it gives current to the primary winding 3 of the electromagnet 4 up to make the piston 9 reach the stop beat. In such way, the first control logic unit 6 is capable to detect with continuity the time ($t_F-t_P$) necessary to the piston for making the whole travel and, as a consequence, the value of the operating counteracting pressure, so as to vary the driving of the electromagnet 4 in order to adapt the capacity regulation to the variations of the operating counteracting pressure.

In fact, on the basis of the value of the operating counteracting pressure, by knowing the elastic coefficient of the membrane, it is possible to calculate the travel necessary for obtaining the required capacity at a given pressure, keeping such capacity constant at any value of the operating pressure.

Figure 8:
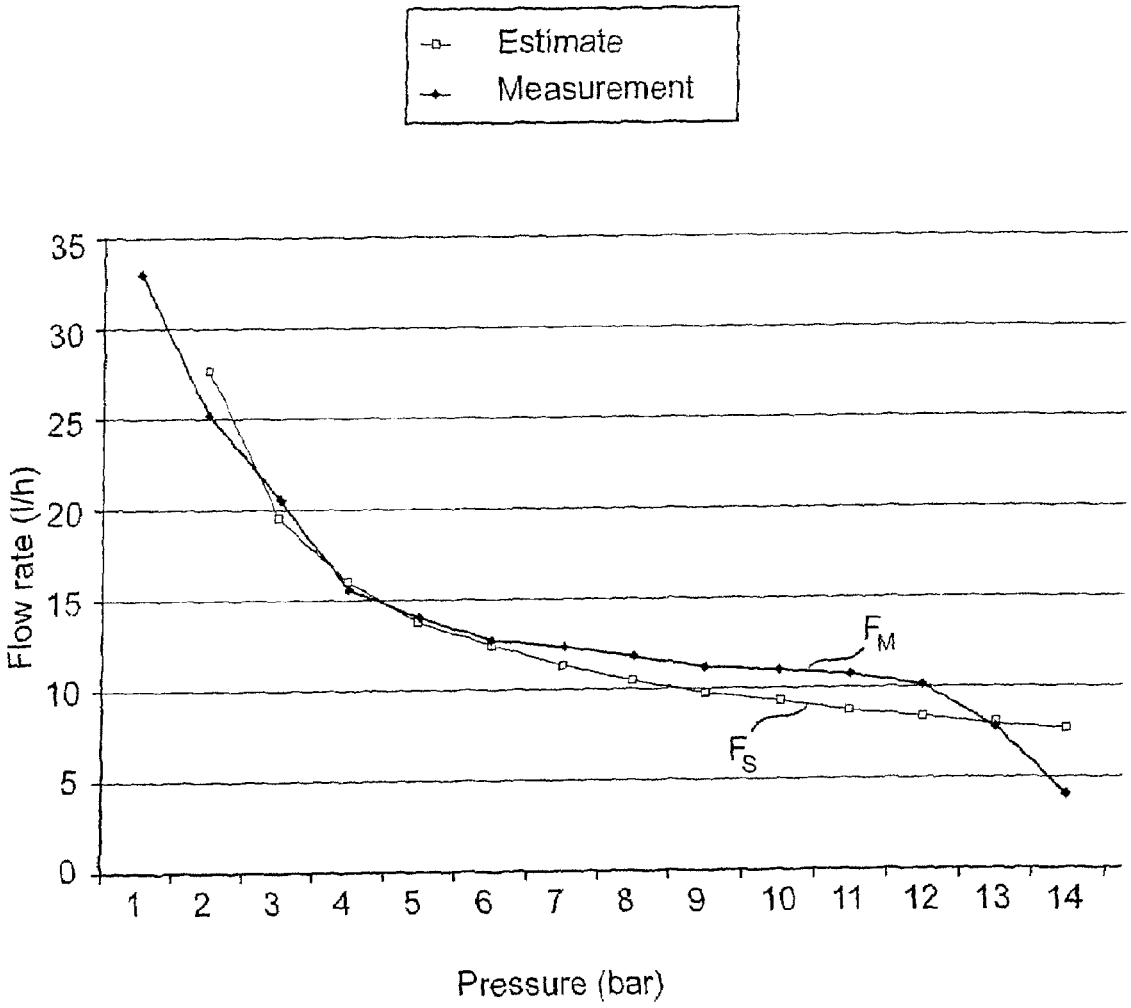
FIG. 8 shows the estimated curve and the measured one of the capacity as a function of the operating pressure for a specific membrane pump.

FIG. 8 shows the estimated curve $F_S$ and the measured curve $F_M$ of the capacity (assuming that the piston always arrives at stop) as a function of the equipment pressure for a specific membrane. The relation between operating pressure P and capacity F is the following:

$$F = F_0 \cdot \frac{1}{\sqrt{P}}$$

where $F_0$ represents a constant (proportional to the elastic coefficient of the membrane) proportional to the capacity obtained with the equipment at 0 bar.

Advantageously, instead of calculating the capacity value as a function of the pressure according to the just shown formula, the first control logic unit 6 is provided with an internal memory storing a (preferably updatable) look-up table wherein, a value of capacity F corresponds to each value of pressure P. Therefore, by cyclically detecting the counteracting operating pressure P as described before, the first control logic unit 6 may simply access the memory and it may read which is the pump capacity for driving of stop of the piston 9, so as to adapt the driving of the electromagnet 4 to the elastic coefficient of the membrane.

Furthermore, the memory of the first control logic unit 6 could store different look-up tables depending on the viscosity of the liquid to let into the external circuit, the value of which causes a corresponding variation in the pump capacity, such viscosity value being able to be set by an operator. Similarly, the memory could store different look-up tables depending on the ageing of the used membrane.

The preferred embodiment of the driving device according to the invention, shown in FIG. 7, also comprises a resistance compensating electronic control stage 10, capable to compensate the variation of the resistance of the primary winding 3 (typically in copper) constituting the inductor with temperature, given by the known Boltzmann law:

$$Rt=Ro(1+\alpha(T-To))$$

where:

Rt is the resistance value at temperature T;

Ro is the resistance value at reference temperature To (usually equal to the room temperature); and $\alpha$ is the Boltzmann constant.

The first control logic unit 6, during the rest phases (i.e. between one stroke and the next one), injects a current into the primary winding 3 lower to the value necessary for producing the attraction of the piston 9 and it measures a voltage drop across the same primary winding 3 (e.g. at terminal PP). Afterwards, it calculates the variation of the resistance of the primary winding 3 (due to the temperature variation) and it modifies the value of the series resistance of the stage 10 for compensating such variation.

In this way, the circuit electrical constants of the electromagnet 4 would remain constant and, consequently, there would be no variation of the curve of the current i(t) through the primary winding 3 as temperature varies, as instead shown in FIG. 6. Therefore, the first control logic unit 6 could detect the operating counteracting pressure by determining the time elapsed since any instant (assumed as reference instant) of the first part C1 of the curve of FIG. 5, even the initial instant $t_0$ at which the current i(t) begins to flow through the electromagnet 4 (i.e. since the instant at which the current has zero value), up to the stop instant $t_F$.

The stage 10 with a series resistance is purely exemplary, since in other embodiments of the device according to the invention the first control logic unit 6 may modify through software the series resistance of the current generator that in turn supplies the electromagnet 4. Moreover, such compensation may be obtained by means of any other device, such as for instance one or more negative temperature coefficient (NTC) resistors.

The advantages offered by the device and the method according to the invention are significant.

First of all, manufacture of such device and related electromagnetic pump is simplified and, consequently, of reduced cost. In fact, all the parts necessary to a mechanical reduction of the travel and any position or pressure electronic or electromechanical sensor are eliminated.

Also, the driving method adopted by the device according to the invention is extremely precise, providing a better dosage uniformity: in fact, by reducing the travel it is possible to significantly increase the number of strokes per time unit.

Still, when the operating counteracting pressure varies, the device according to the invention allows to always dose the same quantity of product, while in the other presently available apparatuses at equipment pressures lower than the calibration one quantities of product much larger than necessary are dosed with considerable waste and greater pollution.

Furthermore, property to prime the dosage liquid remains the optimum one, since the cap has the possibility to still carry out the whole travel.

Moreover, the driving method and the device according to the invention allow a better uniformity of capacity among apparatuses of the same family, since in phase of burn-in or ageing the device may learn the quantity of travel necessary for reaching the rating capacity.

Still, the cap travel reduction occurs by stopping the advance of the same cap, instead of moving the advance origin, as it is in present mechanical control come systems. Therefore, the injected liquid volume will be always directly proportional to the forward movement of the cap and not to the residual movement as in the mechanical case.

Finally, thanks to their precision properties, the driving method and the device according to the invention allow a better dosage of viscous liquids, by simply taking account in the calculation parameters used by the driving device of one or more corrective factors depending on the viscosity, i.e. by holding the cap in the position for reaching the required capacity for a longer time so that the liquid has enough time to flow.

The present invention has been described, by way of illustration and not by way of limitation, according its preferred embodiment, but it should be understood that those skilled in the art can make variations and/or changes, without so departing from the related scope of protection, as defined by the enclosed claims.

The invention claimed is:

1. A dosing electromagnetic pump comprising an operating electromagnet controlled by a driving device, the electromagnet comprises:

a primary winding configured to be passed through by an energising current, and a moving element, configured to be attracted within the primary winding when said energising current is higher than a first threshold value, the moving element letting a liquid dose into an external hydraulic circuit depending on a travel of the moving element, and the driving device comprises a control logic unit configured to control said energising current, the control logic unit being configured to detect said energising current and provide said energising current to the primary winding until said energising current assumes a second threshold value, depending on a value of the liquid dose to let into the external hydraulic circuit, wherein:

the second threshold value is higher than the first threshold value and not higher than a third threshold value in correspondence of which the moving element arrives at a stop, the second threshold value is the sum of a fourth threshold value, detected at an instant $t_P$ successive, by a constant interval not shorter than 0, to an instant $t_0$ at which said energising current begins to flow through the primary winding and preceding an instant $t_F$ at which said energising current assumes the third threshold value, and the second threshold value is a quantity not larger than the difference between the third threshold value and the fourth threshold value, said quantity depending on the value of the liquid dose to let into the external hydraulic circuit.

2. A pump according to claim 1, wherein:

the fourth threshold value is equal to the first threshold value, and the control logic unit determines the second threshold value as the sum of the first threshold value, detected at the instant $t_P$ successive, by a constant interval ($t_P$–$t_0$), to the instant $t_0$ at which said energising current begins to flow through the primary winding, with a quantity not larger than the difference between the third threshold value and the first threshold value, said quantity depending on the value of the liquid dose to let into the external hydraulic circuit.

3. A pump according to claim 1, wherein the driving device further comprises an electronic means for compensating variations of the resistance of the primary winding controlled by the control logic unit, the control logic unit being configured, when it does not provide said energising current, to provide to the primary winding a measuring current, lower than the first threshold value, and to measure a voltage drop across the primary winding for determining if the resistance of the primary winding is varied and, in the positive, for controlling said electronic compensating means for compensating such resistance variation.

4. A pump according to claim 3, wherein:

the fourth threshold value is equal to 0, and the control logic unit determines the second threshold value as being equal to a quantity not larger than the third threshold value, said quantity depending on the value of the liquid dose to let into the external hydraulic circuit.

5. A pump according to claim 1, wherein the control logic unit cyclically provides said energising current to the primary winding until said energising current assumes the third threshold value in correspondence of which the moving element arrives at stop.

6. A pump according to claim 5, wherein, when the control logic unit provides said energising current to the primary winding until said energising current assumes the third threshold value, the control logic unit determines a pressure exerted by the external hydraulic circuit onto the pump as proportional to the time interval passing since a reference instant, ranging from the instant $t_0$ at which said energising current begins to flow through the primary winding to the instant $t_F$ at which said energising current assumes the third threshold value.

7. A pump according to claim 6, wherein said reference instant is equal to the instant $t_0$ at which said energising current begins to flow through the primary winding or to the instant $t_P$ at which said energising current assumes the first threshold value.

8. A pump according to claim 6, wherein the control logic unit calculates the second threshold value as a function of the determined pressure.

9. A pump according to claim 6, wherein the control logic unit is provided with memory means storing at least one look-up table which the control logic unit accesses for reading said second threshold value as a function of the determined pressure.

10. A pump according to claim 1, comprising a membrane having an elastic coefficient, the control logic unit determining the second threshold value as a function of the membrane elastic coefficient.

11. A pump according to claim 10, wherein the control logic unit is provided with memory means storing at least one look-up table which the control logic unit accesses for reading the second threshold value as a function of the membrane elastic coefficient.

12. A pump according to claim 1, wherein the driving device further comprises first selecting means, connected to the control logic unit, configured to select said value of the liquid dose to let into the external hydraulic circuit.

13. A pump according to claim 1, wherein the driving device further comprises selecting means, connected to the control logic unit, configured to select a viscosity of the liquid to let into the external circuit.

14. A pump according to claim 13, wherein the control logic unit calculates the second threshold value as a function of the selected viscosity of the liquid to let into the external circuit.

15. A pump according to claim 13, wherein the control logic unit is provided with memory means storing at least one look-up table which the control logic unit accesses for reading the second threshold value as a function of the selected viscosity of the liquid to let into the external circuit.

16. A device for driving an electromagnet, comprising a control logic unit, wherein: the driving device is configured to control an operating electromagnet of a dosing electromagnetic pump, the electromagnet comprises a primary winding configured to be passed through by an energising current, and a moving element configured to be attracted within the primary winding when said energising current is higher than a first threshold value to let a liquid dose into an external hydraulic circuit depending on a travel of the moving element, the control logic unit being configured to control said energising current, the control logic unit being configured to detect said energising current to provide said energising current to the primary winding until said energising current assumes a second threshold value, depending on a value of the liquid dose to let into the external hydraulic circuit, higher than the first threshold value and not higher than a third threshold value in correspondence of which the moving element arrives at a stop, wherein the control logic unit determines the second threshold value as the sum of a fourth threshold value, detected at an instant $t_P$ successive, by a constant interval not shorter than 0, to an instant $t_0$ at which said energising current begins to flow through the primary winding and preceding an instant $t_F$ at which said energising current assumes the third threshold value, with a quantity not larger than the difference between the third threshold value and the fourth threshold value, said quantity depending on the value of the liquid dose to let into the external hydraulic circuit.

17. A method for driving an electromagnet for operating a pump, the electromagnet comprising a primary winding, configured to be passed through by an energising current, and a moving element configured to be attracted within the primary winding when said energising current is higher than a first threshold value to let a liquid dose into an external hydraulic circuit as a function of the travel of the moving element, the method comprising the following steps:

A. detecting said energising current;

B. providing said energising current to the primary winding until said energising current assumes a second threshold value depending on a value of the liquid dose to let into the external hydraulic circuit, the second threshold being larger than the first threshold value and not larger than a third threshold value in correspondence of which the moving element arrives at a stop;

wherein, in step B, the second threshold value is determined as the sum of a fourth threshold value, detected at an instant $t_P$ successive, by a constant interval not shorter than 0, to an instant $t_0$ at which said energising current begins to flow through the primary winding and preceding an instant $t_F$ at which said energising current assumes the third threshold value, with a quantity not larger than the difference between the third threshold value and the fourth threshold value, said quantity depending on the value of the liquid dose to let into the external hydraulic circuit.

18. A method according to claim 17, wherein the fourth threshold value is equal to the first threshold value, whereby in step B the second threshold value is determined as the sum of the first threshold value, detected at the instant $t_P$ successive, by a constant interval ($t_P$–$t_0$), to the instant $t_0$ at which said energising current begins to flow through the primary winding, with a quantity not larger than the difference between the third threshold value and the first threshold value, said quantity depending on the value of the liquid dose to let into the external hydraulic circuit.

19. A method according to claim 17, further comprising the following steps:

C. providing to the primary winding a measuring current, lower than the first threshold value, and D. measuring a voltage drop across the primary winding for determining if the resistance of the primary winding is varied and, in the positive, for compensating such resistance variation.

20. A method according to claim 19, wherein the fourth threshold value is equal to 0, whereby in step B the second threshold value is determined as being equal to a quantity not larger than the third threshold value, said quantity depending on the value of the liquid dose to let into the external hydraulic circuit.

21. A method according to claim 17, further comprising the following step:

E. cyclically providing said energising current to the primary winding until said energising current assumes the third threshold value in correspondence of which the moving element arrives at stop.

22. A method according to claim 21, wherein, in step E a pressure exerted by the external hydraulic circuit onto the pump is determined as proportional to the time interval passing since a reference instant, ranging from the instant $t_0$ at which said energising current begins to flow through the primary winding to the instant $t_F$ at which said energising current assumes the third threshold value.

23. A method according to claim 22, wherein said reference instant is equal to the instant $t_0$ at which said energising current begins to flow through the primary winding or to the instant $t_P$ at which said energising current assumes the first threshold value.

24. A method according to claim 22, wherein in step B the second threshold value is calculated as a function of the pressure value determined in step E.

25. A method according to claim 22, wherein in step B the second threshold value is read from a look-up table depending on the external pressure value determined in step E.

26. A method according to claim 17, wherein the pump comprises a membrane having an elastic coefficient, and in step B the second threshold value is determined as a function of the membrane elastic coefficient.

27. A method according to claim 26, wherein in step B the second threshold value is read from a look-up table depending on the membrane elastic coefficient.

28. A method according to claim 17, further comprising the following step:

F. selecting said value of the liquid dose to let into the external hydraulic circuit.

29. A method according to claim 17, further comprising the following step:

G. selecting a viscosity of the liquid to let into the external circuit.

30. A method according to claim 29, wherein in step B the second threshold value is calculated as a function of the liquid viscosity selected in step G.

31. A method according to claim 29, wherein in step B the second threshold value is read from a look-up table depending on the liquid viscosity selected in step G.

32. A pump according to claim 9, wherein said at least one look-up table is updatable.

33. A pump according to claim 11, wherein said at least one look-up table is updatable.

34. A pump according to claim 15, wherein said at least one look-up table is updatable.

* * * * *